US007156085B2

(12) United States Patent
Lewis et al.

(10) Patent No.: US 7,156,085 B2
(45) Date of Patent: Jan. 2, 2007

(54) TOY GUN

(75) Inventors: Michael G. Lewis, Lake Orion, MI (US); Jeffrey C. Zimmerman, King of Prussia, PA (US)

(73) Assignee: Buzz Bee Toys (H.K.) Co., Limited, Hong Kong (CN)

( * ) Notice: Subject to any disclaimer, the term of this patent is extended or adjusted under 35 U.S.C. 154(b) by 70 days.

(21) Appl. No.: 10/949,648

(22) Filed: Sep. 24, 2004

(65) Prior Publication Data

US 2006/0064911 A1 Mar. 30, 2006

(51) Int. Cl.
*F41B 11/22* (2006.01)

(52) U.S. Cl. ..... 124/66; 124/63; 42/54

(58) Field of Classification Search ..... 124/63–67, 124/41.1; 42/40
See application file for complete search history.

(56) References Cited

U.S. PATENT DOCUMENTS

| | | | | | |
|---|---|---|---|---|---|
| 420,316 | A * | 1/1890 | Stanley | 124/67 |
| 1,477,770 | A * | 12/1923 | Roe | 124/66 |
| 1,854,605 | A * | 4/1932 | Tratsch | 124/76 |
| 2,306,668 | A * | 12/1942 | Stevens | 124/67 |
| 3,465,744 | A * | 9/1969 | Nielsen | 124/27 |
| 5,186,156 | A * | 2/1993 | Clayton | 124/59 |
| 5,205,271 | A * | 4/1993 | Casas Salva | 124/66 |
| 5,529,050 | A * | 6/1996 | D'Andrade | 124/56 |
| 5,575,270 | A * | 11/1996 | Casas-Salva | 124/67 |
| 5,660,159 | A * | 8/1997 | Clayton | 124/66 |
| 5,878,735 | A * | 3/1999 | Johnson | 124/59 |
| 5,913,304 | A * | 6/1999 | Johnson | 124/59 |
| 5,944,006 | A * | 8/1999 | Moore et al. | 124/65 |
| 6,397,505 | B1 * | 6/2002 | Stratton et al. | 42/47 |

FOREIGN PATENT DOCUMENTS

FR 2619440 A1 * 2/1989

* cited by examiner

*Primary Examiner*—Michael J. Carone
*Assistant Examiner*—Stewart Knox
(74) *Attorney, Agent, or Firm*—Alix, Yale & Ristas, LLP

(57) ABSTRACT

A toy gun includes a barrel having a bay for receiving a soft projectile loaded within a cartridge. A stock is connected pivotally to the barrel and encases a pneumatic cylinder and piston that is primed upon pivotally opening the stock and barrel. The pneumatic cylinder and piston communicate with the bay when the stock and barrel are closed. A trigger releases the piston to force air into the bay for dispatching the projectile from the cartridge—leaving the cartridge within the bay for ejection upon opening of the stock and barrel.

6 Claims, 9 Drawing Sheets

TOY GUN

BACKGROUND OF THE INVENTION

The present invention relates to toy guns. More particularly, although not exclusively, the invention relates to a toy rifle having reusable cartridge-loaded soft projectiles that are fired pneumatically by a pneumatic cylinder.

Toy guns that fire soft darts or projectiles are known. These usually comprise some kind of spring-firing mechanism that shoots the soft projectiles from a barrel.

OBJECT OF THE INVENTION

It is an object of the present invention to provide an alternative toy gun in which soft projectiles are fired pneumatically from reusable cartridges.

DISCLOSURE OF THE INVENTION

There is disclosed herein a toy gun, comprising:

a barrel having a bay for receiving a soft projectile, a stock connected pivotally to the barrel and encasing a pneumatic cylinder and piston that is primed upon pivotally opening the stock and barrel, the pneumatic cylinder and piston communicating with the bay when the stock and barrel are closed, and a trigger for releasing the piston to force air into the bay for dispatching a projectile therefrom.

Preferably, the toy gun further comprises a cable extending from the barrel to the stock and attached to the piston to prime the piston upon opening the stock and barrel.

Preferably, the toy gun further comprises a lever mounted within the stock and a pawl that engages an small step in a piston support rod.

Preferably, the toy gun further comprises a series of pulleys mounted within the stock and barrel and about which the cable extends.

There is further disclosed herein a toy gun, comprising:

a barrel having a bay for receiving a cartridge loaded with a soft projectile, a stock connected pivotally to the barrel and encasing a pneumatic cylinder and piston that is primed upon pivotally opening the stock and barrel, the pneumatic cylinder and piston communicating with the cartridge when the stock and barrel are closed, and a trigger for releasing the piston to force air into the cartridge for dispatching the projectile from the cartridge, whilst maintaining the cartridge within the bay.

Preferably, the toy gun further comprises a spring within the bay that is compressed upon insertion of the cartridge into the bay, and further comprising a lock that holds the cartridge within the bay against compression of the spring.

Preferably, the lock engages with the stock to release the cartridge for ejection by the spring upon opening of the barrel from the stock.

There is further disclosed herein a combination comprising a cartridge and a soft projectile located within the cartridge, the projectile comprising a tubular body having a blind passage, the cartridge comprising a casing and an air injector post extending into the blind passage of the tubular body and an air injection port for sealing against a gun from which air is injected into the air injector post for dispatch of the projectile from the cartridge.

Preferably, the combination further comprises a suction cup mounted at one end of the projectile.

Preferably, the tubular body is made of foam.

BRIEF DESCRIPTION OF THE DRAWINGS

A preferred form of the present invention will now be described by way of example with reference to the accompanying drawings, wherein.

DESCRIPTION OF THE PREFERRED EMBODIMENT

Figure 1:
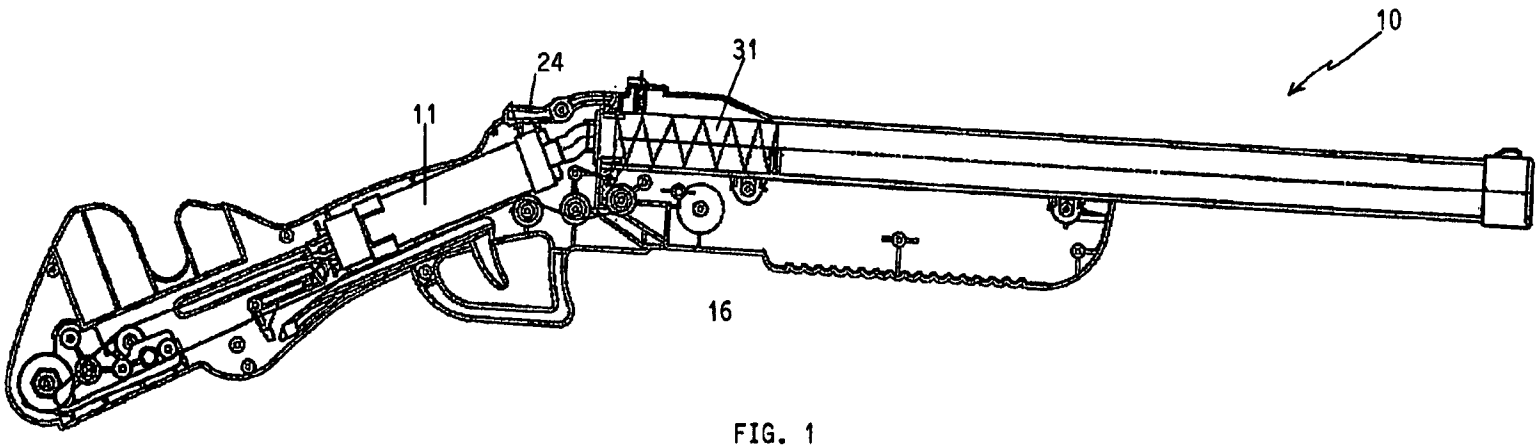
FIG. 1 is a schematic cross-sectional elevation of the toy gun.
Figure 2:
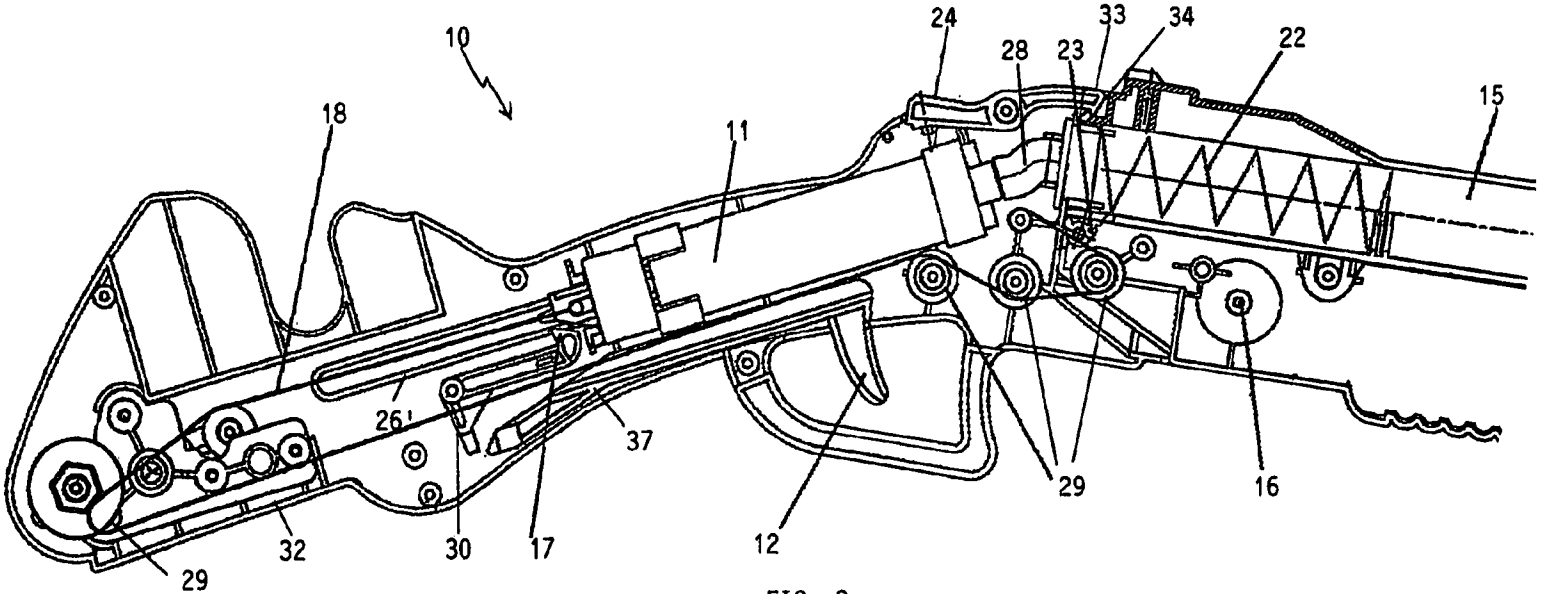
FIG. 2 is a schematic cross-sectional elevation of the mid-section of the toy gun of FIG. 1.

In the accompanying drawings there is depicted schematically the toy gun 10 typically formed of moulded plastics material. The toy gun includes a barrel 15 and the stock 32 connected pivotally to one another at pivot 16. The barrel is held in a closed configuration with respect to the stock by a barrel release switch 24 having a catch 33 that clips upon a mating catch 34 at the back of the barrel 15.

Figure 6:
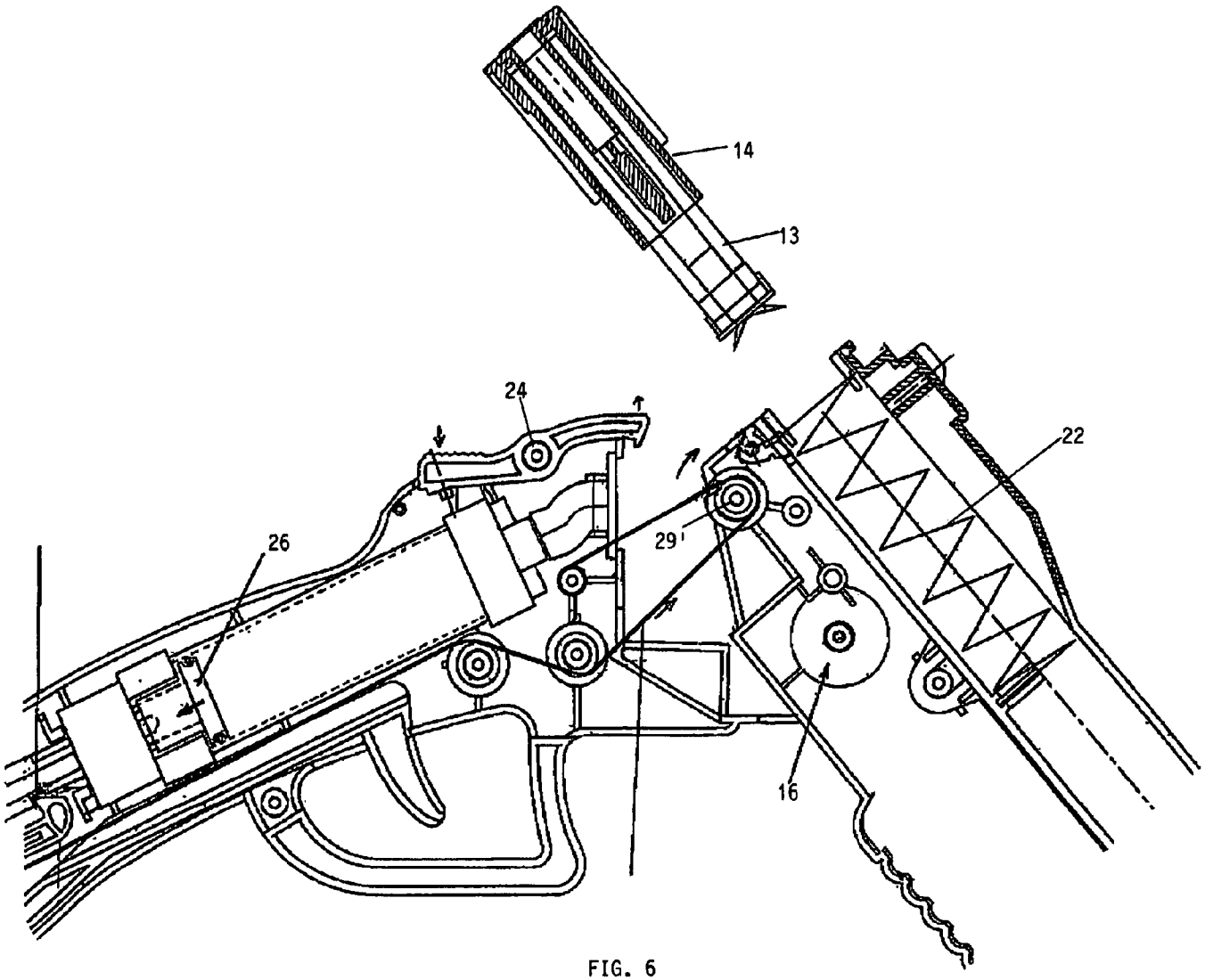
FIG. 6 is a schematic cross-sectional elevation of the mid-section of the toy gun in an open, unloaded state.
Figure 7:
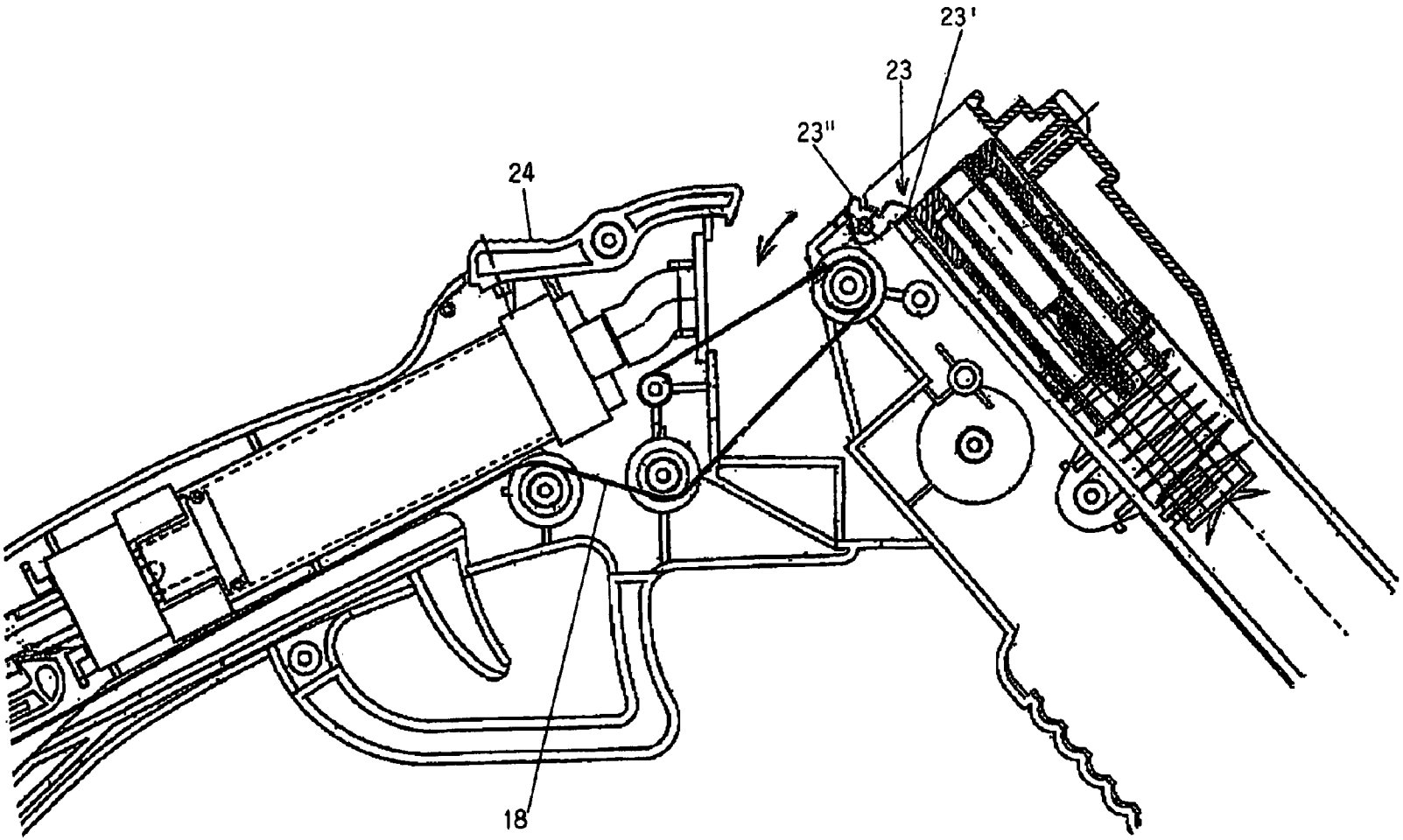
FIG. 7 is a schematic cross-sectional elevation of the mid-section of the toy gun in an open, loaded state.
Figure 8:
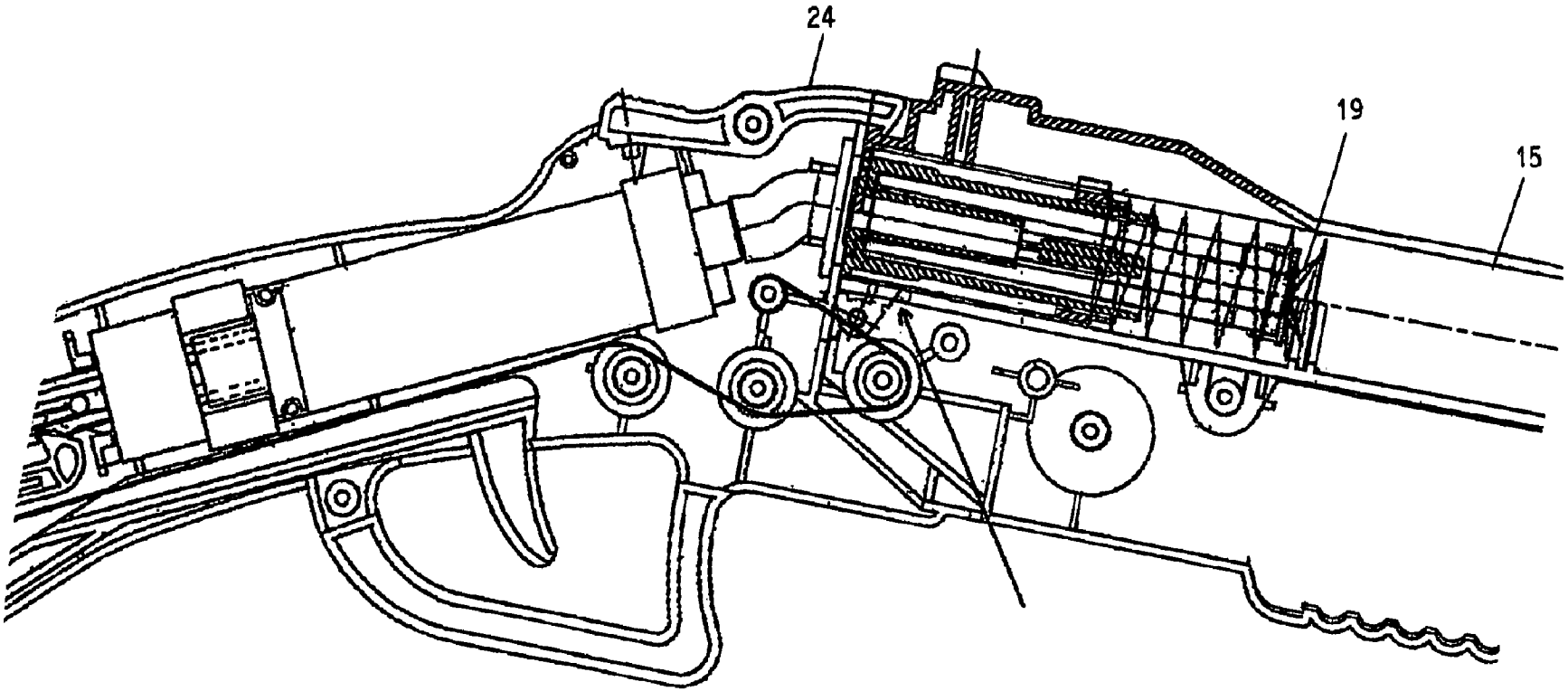
FIG. 8 is a schematic cross-sectional elevation of the mid-section of the toy gun in a closed, loaded state.
Figure 9:
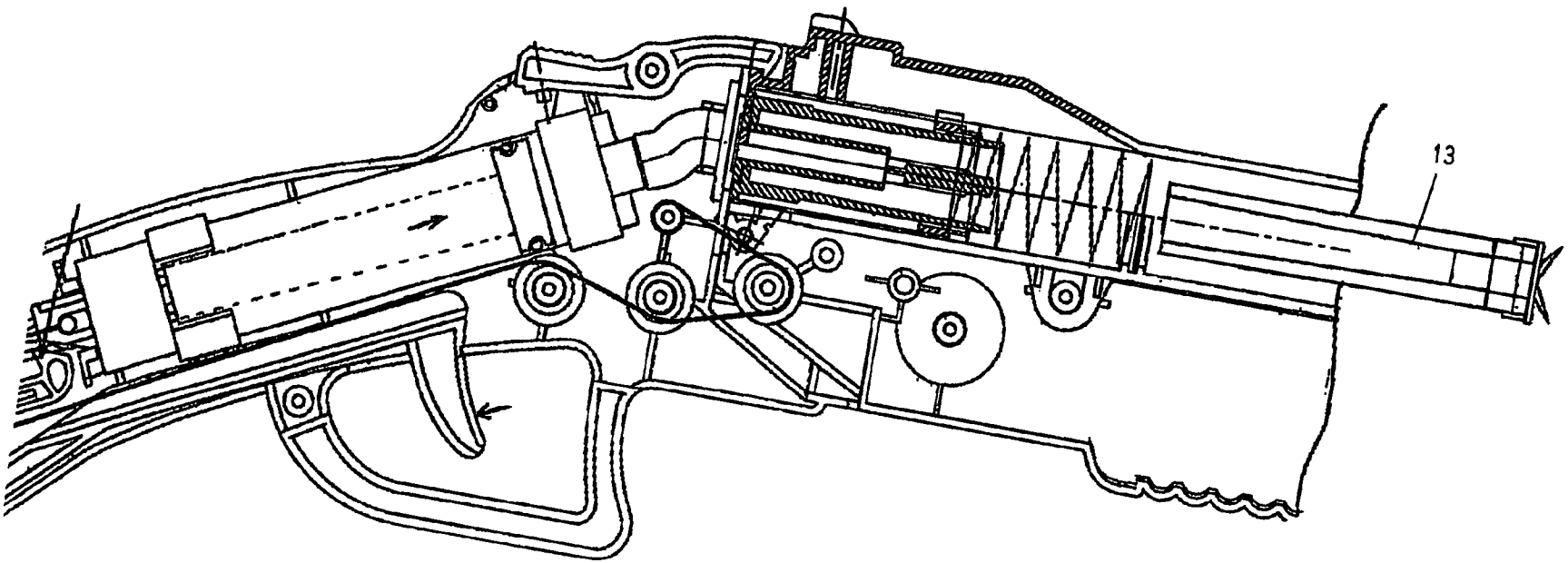
FIG. 9 is a schematic cross-sectional elevation of the mid-section of the toy gun in a closed, just fired state.
Figure 10:
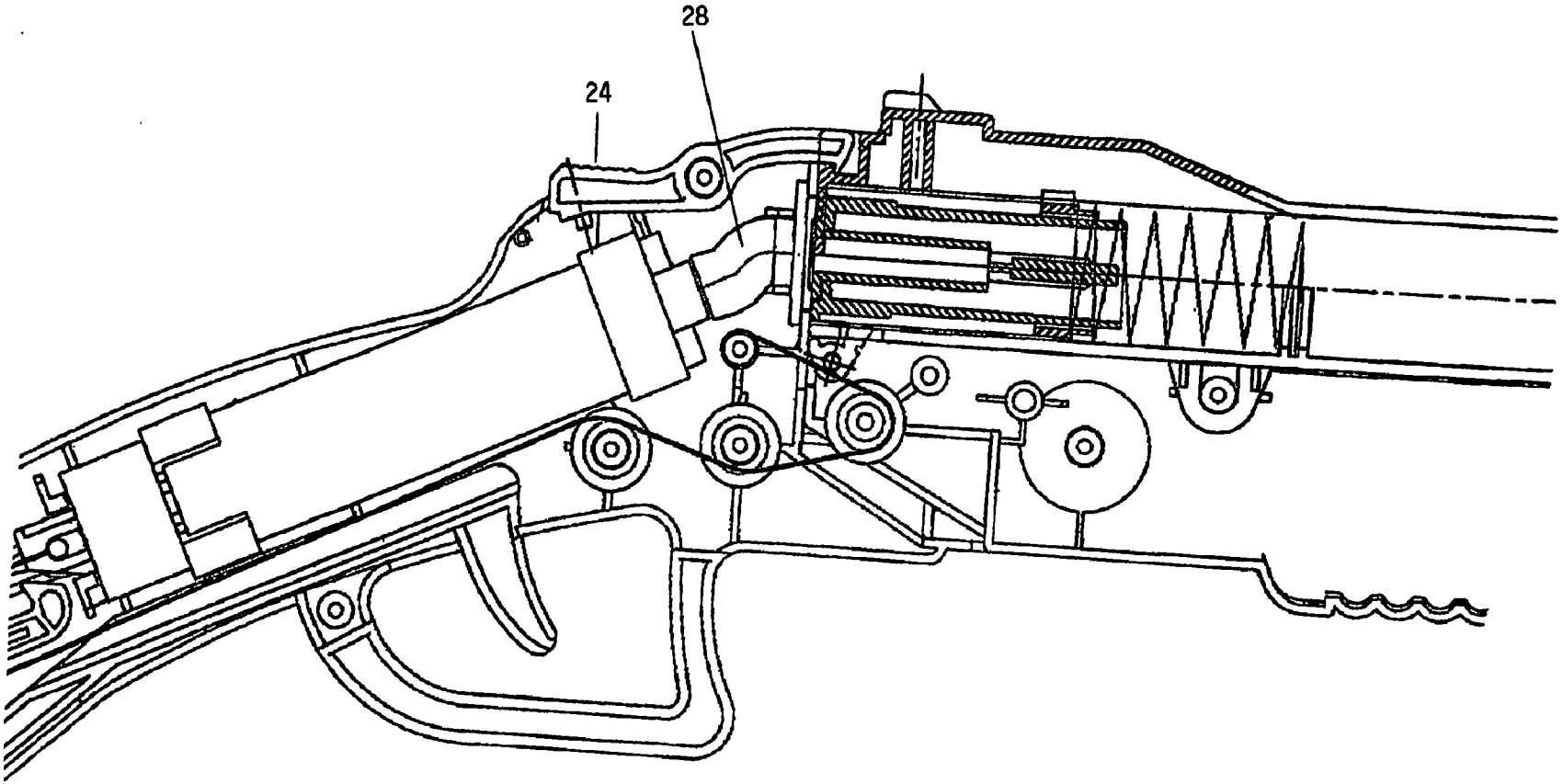
FIG. 10 is a schematic cross-sectional elevation of the mid-section of the toy gun in a closed, fired state.
Figure 11:
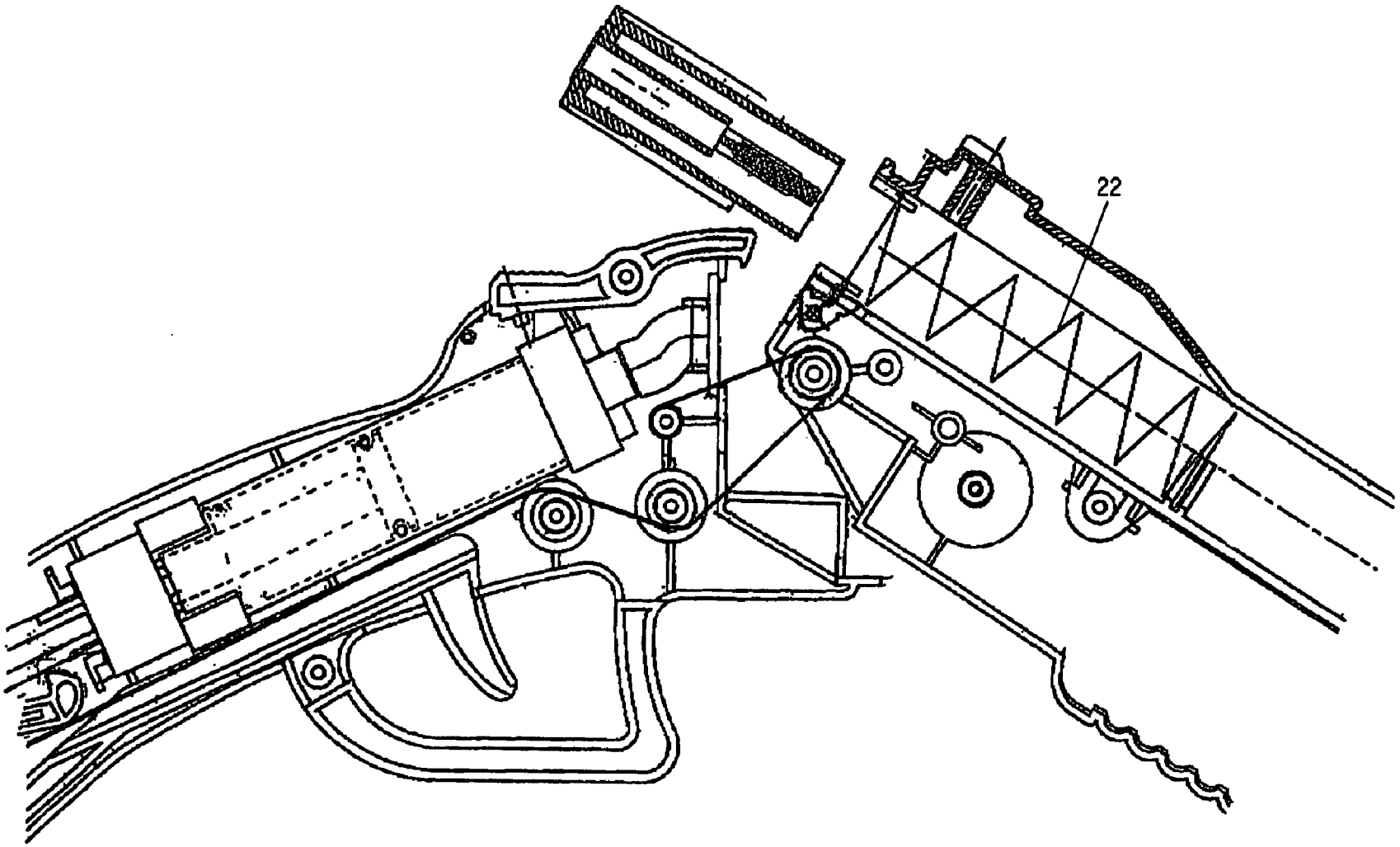
FIG. 11 is a schematic cross-sectional elevation of the mid-section of the toy gun in the open, cartridge-eject state.

The stock houses a pneumatic ram 11 comprising a cylinder and internal reciprocating piston 26. The piston 26 is supported on a lengthwise rod 26'. A cable 18 extends from the piston about a number of pulleys 29 and attaches at its other end to an anchor 35 at the forward end of the stock. One of the pulleys 29' is mounted within the barrel section of the gun near the pivot 16. When the barrel release switch 24 is depressed as shown in FIG. 6, the barrel can be opened whereupon the pulley 29' draws upon the cable 18 to prime the piston 26 to its pre-firing position.

Attached to the forward end of the pneumatic ram 11 is a pneumatic line 28 communicating the internal volume of the pneumatic ram that is forward of the piston with a resilient seal 25 mounted firmly at the front of the stock.

Within the barrel there is a cartridge cartridge bay 36 within which there is located a light compression spring 22 that is compressed by a pre-loaded cartridge when inserted into the cartridge bay 36. At the opening to the cartridge bay 36, there is a pivotal locking member 23 to retain a cartridge within the cartridge bay until the gun is opened. The locking member has a tab 23' that extends into the cartridge bay and a buffer 23" that faces towards the stock 32. When the barrel is closed against the stock, the buffer 23" keeps the locking member so oriented as to retain the cartridge in position. When the barrel release switch is pressed, and the barrel pivoted down with respect to the stock, the spring force applied by the light spring 22 presses the cartridge against the tab 23' to pivotal locking member back and allowed ejection of the cartridge.

Figure 3:
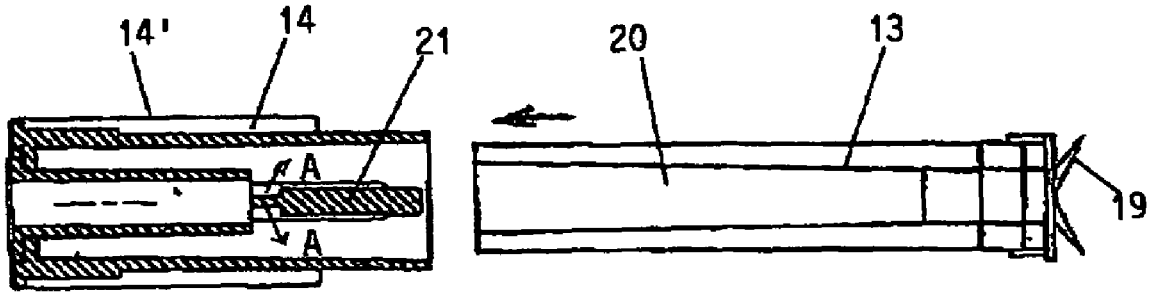
FIG. 3 is a schematic cross-sectional elevation of a cartridge and projectile separated from one another.

The cartridge 14 has a base that seals against the resilient seal 25 when the barrel is closed upon the stock. The cartridge is a hollow cylinder having longitudinal fins 14'—the forward ends of which compress the spring 22 upon insertion of the cartridge into the cartridge bay. The cartridge 14 includes an air injector post 21 at its centre defining a deep annulus thereabout. The air injector post is hollow to enable the passage of air from the pneumatic line 28 therethrough for release as shown by arrows A in FIG. 3.

Figure 4:
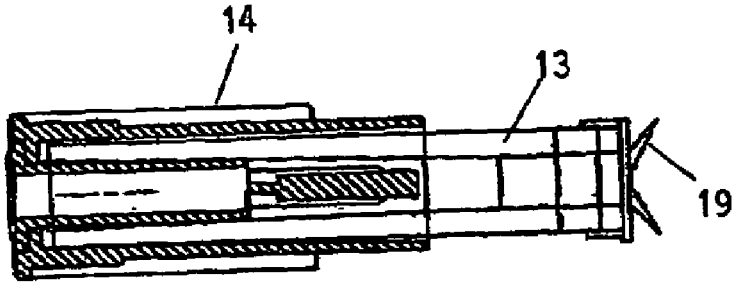
FIG. 4 is a schematic cross-sectional elevation of the cartridge and projectile of FIG. 3 with the projectile loaded into the cartridge.
Figure 5:
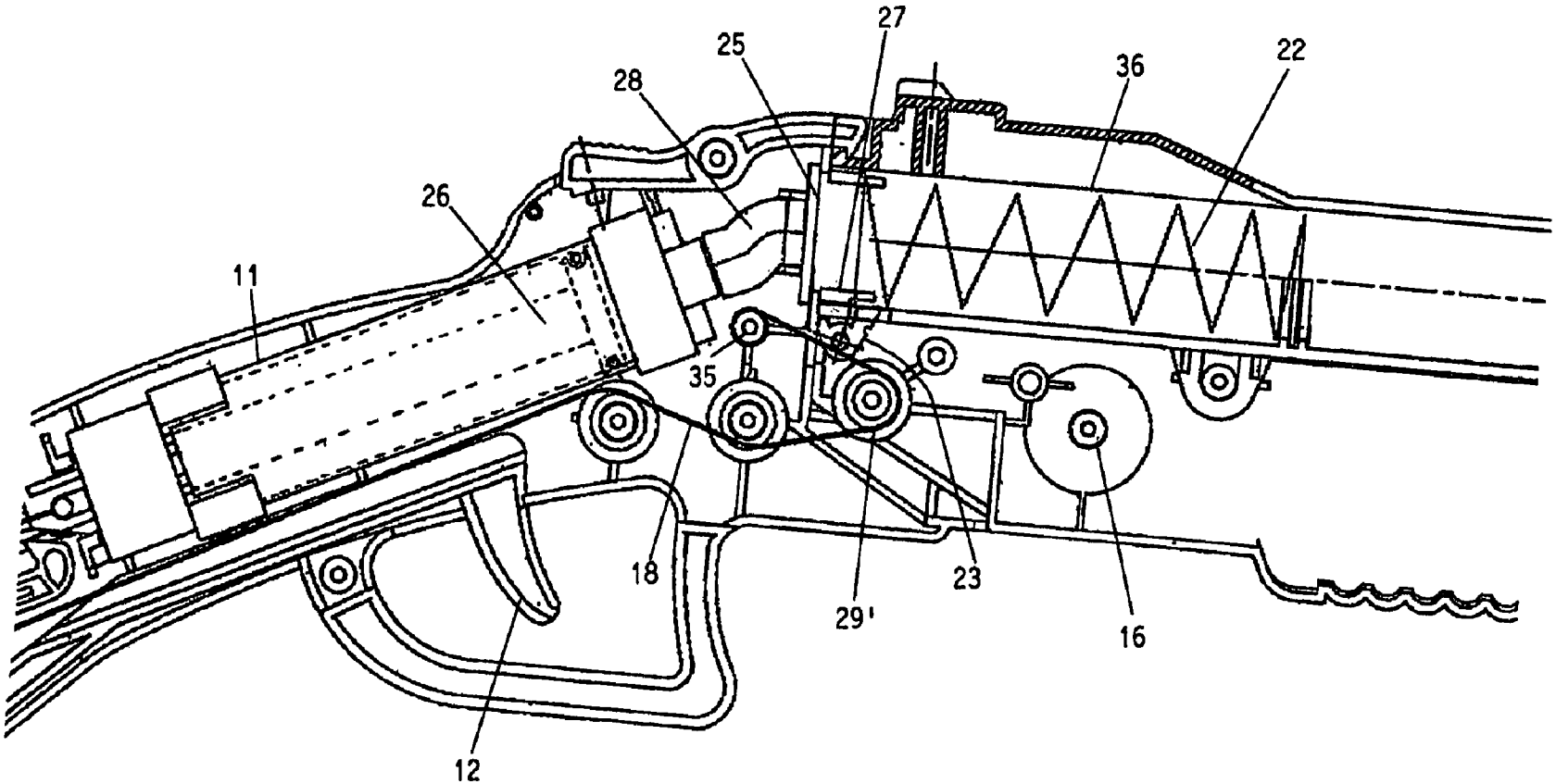
FIG. 5 is a schematic cross-sectional elevation of the mid-section of the toy gun in a closed, unloaded state.

A soft projectile 13 that is typically made of foam plastics material has a plastics suction cup 19 fixed at its forward end. The projectile is tubular in form and includes a blind passage 20. The projectile fits partially into the annulus and over the air injector post 21 as shown in FIG. 4.

The gun comprises a trigger 12 extending from a pushbar 37. An L-shaped lever 30 is mounted within the stock and has a pawl 17 engaging with a small step in the piston support rod 26". Upon pulling the trigger 12, the pusher bar 37 bears against the lever 30 so that the pawl 17 releases the piston rod 26". There could be a strong compression spring within the pneumatic ram 11 to bias the piston forward. Alternatively, the volume of air behind the piston within the cylinder could be compressed upon the drawing the piston back to provide the necessary potential for rapid release of the piston upon depression of the trigger 12.

Upon depression of the trigger, the piston moves rapidly forward to force a blast of air through the pneumatic line, through the seal and the air injector post to rapidly pressurise air within the hollow 20 of the projectile 13. This will cause the projectile to be despatched from the barrel. The cartridge remains within the bay 36 until the barrel release switch 24 is depressed, whereupon pivotal opening of the barrel, the "spent" cartridge is ejected for reloading.

It should be appreciated that modifications and alterations obvious to those skilled in the art are not to be considered as beyond the scope of the present invention. For example, instead of priming the pneumatic ram by the specific cable mechanism depicted, a pump action or other priming mechanism might be adopted. Also, it should be appreciated that the depicted mechanism can comprise twin barrels of, twin cartridge bays, twin pneumatic rams etc.

The invention claimed is:

1. A toy gun, comprising:

a barrel having a bay for receiving a soft projectile, a stock connected pivotally to the barrel and encasing a pneumatic cylinder and piston that is primed upon pivotally opening the stock and barrel, the pneumatic cylinder and piston communicating with the bay when the stock and barrel are closed, a trigger for releasing the piston to force air into the bay for dispatching a projectile therefrom, a cable extending from the barrel to the stock and attached to the piston to prime the piston upon opening the stock and barrel, and a series of pulleys mounted within the stock and barrel about which the cable extends.

2. The toy gun of claim 1, further comprising a lever mounted within the stock and having a pawl that engages a small step in a piston support rod.

3. A toy gun, comprising:

a barrel having a bay for receiving a cartridge loaded with a soft projectile, a stock connected pivotally to the barrel and encasing a pneumatic cylinder and piston that is primed upon pivotally opening the stock and barrel, the pneumatic cylinder and piston communicating with the cartridge when the stock and barrel are closed, a trigger for releasing the piston to force air into the cartridge for dispatching the projectile from the cartridge, whilst maintaining the cartridge within the bay, a cable extending from the barrel to the stock and attached to the piston to prime the piston upon opening the stock and barrel, and a series of pulleys mounted within the stock and barrel about which the cable extends.

4. The toy gun of claim 3, further comprising a spring within the bay that is compressed upon insertion of the cartridge into the bay, and further comprising a lock that holds the cartridge within the bay against compression of the spring.

5. The toy gun of claim 4, wherein the lock engages with the stock to release the cartridge for ejection by the spring upon opening of the barrel from the stock.

6. The toy gun of claim 5, wherein the opening of the barrel ejects the cartridge from the bay.

* * * * *